US007588448B2

(12) United States Patent
Remes et al.

(10) Patent No.: US 7,588,448 B2
(45) Date of Patent: Sep. 15, 2009

(54) AIRTIGHT ELECTRICAL SOCKET

(75) Inventors: Timo Remes, Turku (FI); Johannes Väänänen, Oulu (FI)

(73) Assignee: Ball-IT Oy, Oulu (FI)

( * ) Notice: Subject to any disclaimer, the term of this patent is extended or adjusted under 35 U.S.C. 154(b) by 0 days.

(21) Appl. No.: 12/057,400

(22) Filed: Mar. 28, 2008

(65) Prior Publication Data

US 2008/0242136 A1 Oct. 2, 2008

Related U.S. Application Data

(63) Continuation of application No. PCT/FI2008/000029, filed on Feb. 19, 2008.

(30) Foreign Application Priority Data

Mar. 30, 2007 (FI) ..... 20070259

(51) Int. Cl.
*H01R 13/44* (2006.01)

(52) U.S. Cl. ..... 439/137; 439/272

(58) Field of Classification Search ..... 439/137, 439/138, 272

See application file for complete search history.

(56) References Cited

U.S. PATENT DOCUMENTS 2,239,653 A * 4/1941 O'Brien ..... 439/137
2,279,516 A * 4/1942 O'Brien ..... 439/137
2,619,515 A * 11/1952 Doane ..... 439/274
3,096,132 A * 7/1963 Hubbell ..... 439/137
3,127,230 A * 3/1964 Marquis ..... 439/178
4,085,993 A * 4/1978 Cairns ..... 439/201
4,109,989 A * 8/1978 Snyder et al. ..... 439/140
4,299,434 A * 11/1981 Ishikawa ..... 439/394
4,411,491 A * 10/1983 Larkin et al. ..... 385/73
4,795,354 A * 1/1989 Owen ..... 439/137
4,796,159 A * 1/1989 Miksche ..... 361/832
5,153,988 A * 10/1992 Mattis et al. ..... 29/863
5,540,450 A 7/1996 Hayashi et al.

(Continued)

FOREIGN PATENT DOCUMENTS

DE 950206 10/1956

(Continued)

*Primary Examiner*—Neil Abrams
(74) *Attorney, Agent, or Firm*—Young & Thompson

(57) ABSTRACT

The invention relates to an electrical socket (110) that is water and/or airtight. In particular, the invention relates to a water and/or airtight electrical socket (110) for portable electronic devices (500). The invention involves sealing elements (200, 210, 220 and 230) that are shaped like an arc, and arranged to seal only a portion of the perimeter of the socket-plug interface (300, 310). When this arc element experiences pressure, it will mechanically relay the force caused by the pressure only to that section of the perimeter of the socket-plug interface (300, 310) that it is arranged to seal. It will not relay mechanical forces any further. This way, the mechanical effect of any extra asymmetric pressure will simply be limited to increasing the pressure of the seal in the perimeter section of that particular sealing element (200, 210, 220 and 230), thereby tightening the seal further still. The methods and arrangements of the invention allow the socket opening (100) to be sealed in an water- and/or airtight manner even in asymmetric pressure conditions, for example when pressed with fingers, both when there is no plug (700) in the socket (110) and also when a plug (700) is inside the socket (110).

18 Claims, 7 Drawing Sheets

U.S. PATENT DOCUMENTS

| | | | | |
|---|---|---|---|---|
| 5,645,442 | A | 7/1997 | Cairns | |
| 6,227,900 | B1 * | 5/2001 | Heise | 439/426 |
| 7,104,817 | B2 * | 9/2006 | Shiue et al. | 439/137 |
| 2004/0082218 | A1 * | 4/2004 | Stirling | 439/587 |

FOREIGN PATENT DOCUMENTS

| | | | |
|---|---|---|---|
| DE | 8625124 | | 1/1987 |
| EP | 1821180 | * | 8/2007 |
| FI | 874089 | | 3/1988 |
| GB | 1236663 | | 6/1971 |

* cited by examiner

AIRTIGHT ELECTRICAL SOCKET

The present application is a continuation of PCT Application No. PCT/FI2008/00029 filed Feb. 19, 2008.

TECHNICAL FIELD OF INVENTION

The invention relates to an electrical socket that is water and/or airtight. In particular, the invention relates to a water and/or airtight electrical socket for portable electronic devices.

BACKGROUND

Electrical socket and plug systems are common in portable electronic devices that need to be charged by electricity. However, the opening of the socket, to which the plug is typically inserted is susceptible to contamination, moisture and other harmful effects that may hinder the operation of the plug-socket system. Therefore it is important to protect the socket-plug systems by providing a seal to protect the socket and the plug from the aforementioned disadvantages.

Document U.S. Pat. No. 4,948,377 by Cairns presents a bladder that can be used to protect an electric device when submersed in water. This document is cited here as reference. In U.S. Pat. No. 4,948,377 a seal is provided for the socket-plug system to protect it from high pressure salt water. These seals in accordance with the prior art are annular and elastic in structure, and protect against the symmetric hydrostatic pressure of the salt water. I.e. symmetric pressure means a pressure which is even on the surface to which it is applied. The annularity of the seal has the clear disadvantage that if the seal is subjected to asymmetric pressure, the seal will be compressed harder where the pressure is the hardest, but will be looser in the places where the pressure is less. This effect can be experimented with a rubber circle, if it is pressed from two sides, it will tend to take an oval shape by compressing from the sides it is pressed, and bulging from the sides it is not pressed from. I.e. asymmetric pressure means a pressure which is uneven at some points of the surface to which it is applied.

SUMMARY OF THE INVENTION

The invention under study is directed towards a system and a method for effectively sealing the socket-plug system even in asymmetric pressure conditions.

A further object of the invention is to present a water and/or airtight seal for socket and plug systems that will continue to seal the plug-socket system irrespective of the direction from which either the seal or the electric appliance receives asymmetric pressure, or symmetric pressure.

One aspect of the invention involves sealing elements that are shaped like an arc, and arranged to seal only a portion of the perimeter of the socket-plug interface. When this arc element experiences a force caused by asymmetric pressure, it will mechanically relay that force only to that section of the perimeter of the socket-plug interface that it is arranged to seal. It will not relay mechanical forces any further. This way, the mechanical effect of any extra asymmetric pressure will simply be limited to increasing the pressure of the seal in the perimeter section of that particular sealing element, thereby tightening the seal further still. This way the possible secondary mechanical response of loosening pressure in some portion of any annular structure is avoided.

According to another aspect of the invention, the seal of the invention is realised in a specialised housing, in which an electrical device is arranged to be inserted. The housing will have an opening for a socket, and this opening is sealed with the seal of the invention. The electrical socket of the electrical device is simply aligned with the socket opening in the housing, so that a plug may be inserted through the opening and the seal to charge the electrical device. If this housing is pressed with, say fingers, resulting in asymmetric pressure, the seal will hold by redirecting the asymmetric pressure to some sections of the perimeter of the socket-plug interface with special compressible pressure redirecting elements.

Some or all of the aforementioned advantages of the invention are accrued by an electric socket with the aforementioned seal, or a housing for an electrical device having the aforementioned seal wherein at least the seal or at least one sealing element is manufactured by plastic or silicone moulding and/or injection moulding.

An electrical socket in accordance with the invention realised in an electrical appliance for housing a plug with the socket further comprises a seal, and

- the seal is composed of at least two sealing elements, and arranged to seal the socket opening,
- the plug is arranged to penetrate through the seal through the opening and is characterised in that,
- upon pressure on the electric appliance, at least one sealing element is arranged to compress radially against the longitudinal plug axis thereby tightening the seal of the socket,
- at least one element occupies an arc or portion of the socket opening perimeter less than the full perimeter.

A housing in accordance with the invention is arranged to house an electric appliance comprising an opening for an electric plug and a seal for the opening and is characterised in that, the socket of the electric appliance and the seal of the housing are arranged to form an electrical socket of the preceding paragraph.

Method of producing the socket in accordance with the invention of the preceding paragraphs is characterised in that, all or some parts of the socket and/or seal are manufactured by moulding and/or injection moulding.

Method of securing a plug and socket interface as described in the preceding three paragraphs.

Method of securing a plug and socket interface in accordance with the invention comprises the following steps,

- pressing an electric appliance or its housing,
- at least one sealing element experiences the force caused by the pressure or a part of it,
- sealing element mechanically directs the force caused by the pressure or a part of it further,
- the redirected force caused by the pressure is targeted on a portion of the perimeter of the socket,
- portion of the perimeter of the socket is pressed harder against the plug surface due to added redirected force caused by the pressure.

In addition and with reference to the aforementioned advantage accruing embodiments, the best mode of the invention is considered to be the use of several sealing elements applied to different sections of the perimeter of an electrical socket-plug system interface of a portable electronic device, such as a mobile phone or a computer mouse for protection in asymmetric pressure conditions.

BRIEF DESCRIPTION OF THE DRAWINGS

In the following the invention will be described in greater detail with reference to exemplary embodiments in accordance with the accompanying drawings, in which FIG. 1 demonstrates an embodiment of the inventive socket seal as a mechanical force diagram.

Some of the embodiments are described in the dependent claims.

DETAILED DESCRIPTION OF EMBODIMENTS

Figure 1:
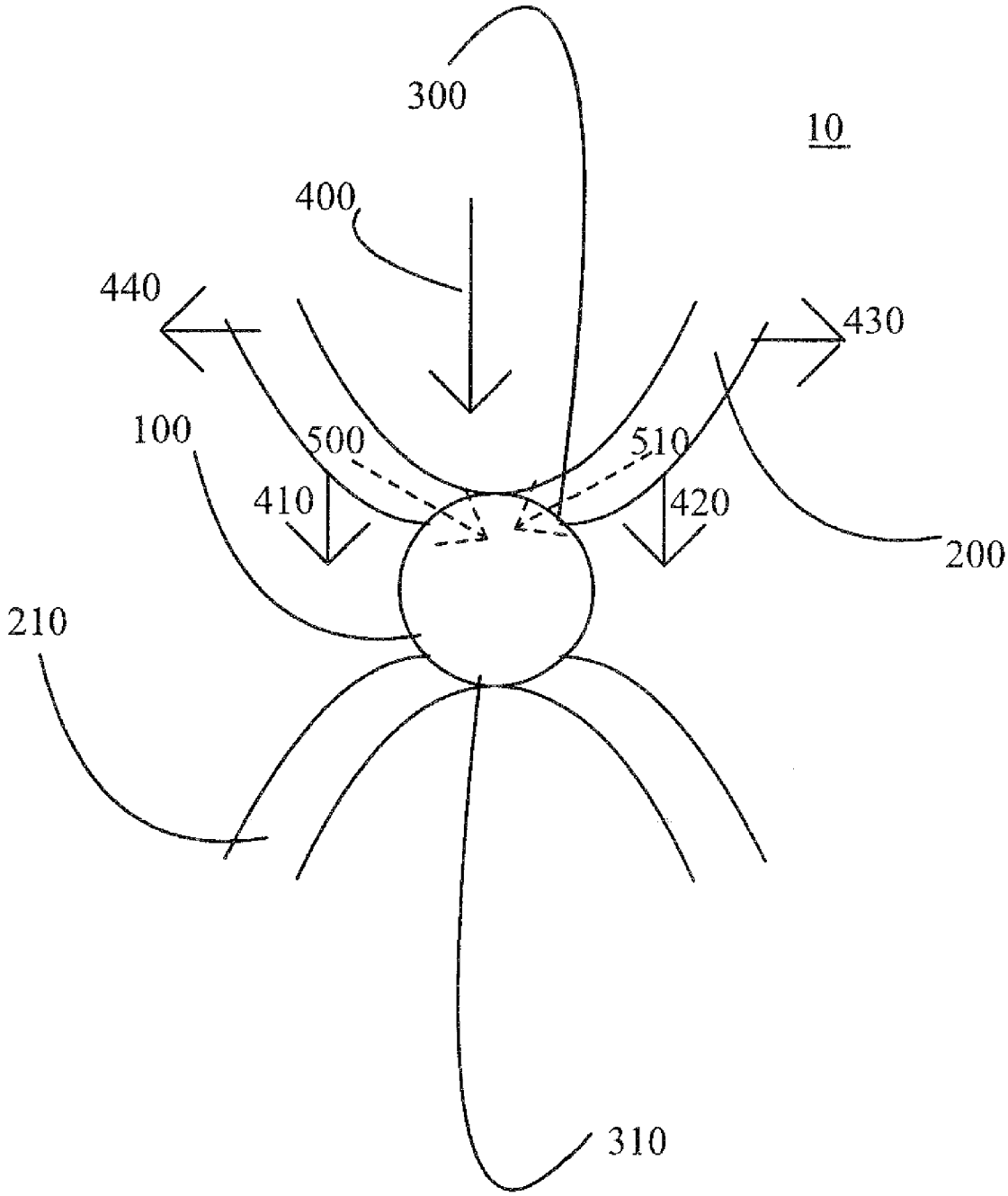

FIG. 1 shows an electrical socket opening 100. Both the opening and the socket cavity behind the opening are typically realised in an electrical appliance for housing a plug with the socket. The electrical appliance can be any mobile phone, wrist watch, clock, camera, music player, electric shaver, or any portable electric device in accordance with the invention. In some embodiments the electrical appliance is a spherical mouse as described in EP 05028777.0 of the applicant which is cited here as reference. In other embodiments of the invention the electrical appliance may be any wired or wireless control device, such as a remote control, for example.

Figure 1B:
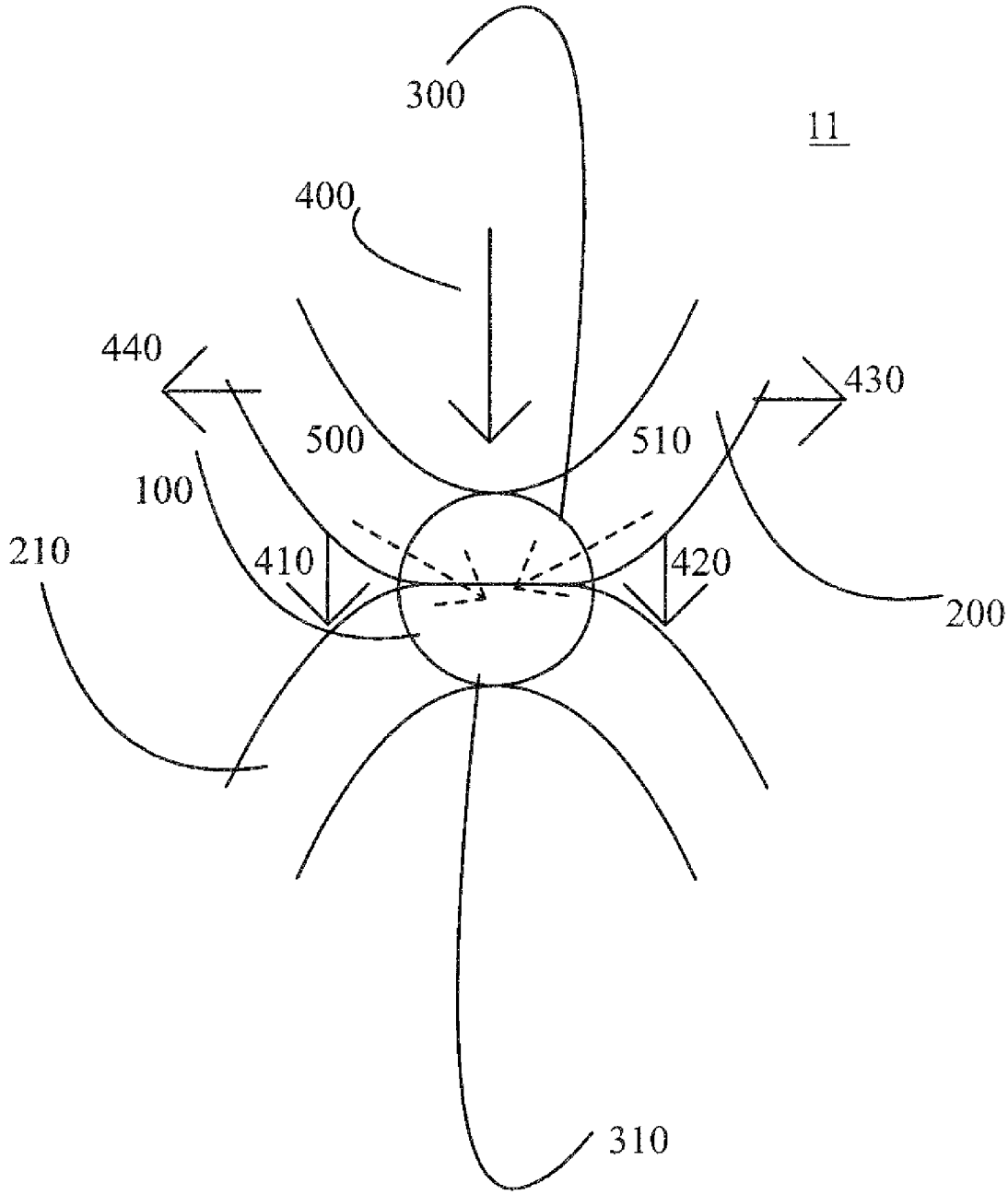

The opening is further either covered or aligned by a seal that is composed of two sealing elements 200 and 210. In FIG. 1 the opening is in the state "open", i.e. either a plug has been inserted, or the seal is pulled away from the opening to reveal the socket opening 100. In FIG. 1B the sealing elements 200 and 210 cover the socket opening 100 from the surroundings, i.e. this is the closed state of the socket seal.

A plug is arranged to penetrate through the seal by pushing the sealing elements 200, 210 from the closed position of FIG. 1B to the open position of FIG. 1. After penetrating through the seal 200, 210 the plug is arranged to continue to penetrate through the opening 100 to the socket cavity and start charging the electrical appliance.

Upon pressure on the electric appliance, at least one sealing element 200, 210 is arranged to compress radially against the longitudinal plug axis thereby tightening the seal of the socket. In FIG. 1 force vector 400 makes a pressure in the direction of the arrow shown, pushing the arc shaped sealing element 200. In this embodiment the shape of the sealing element is an arc, but in other embodiments the sealing element may be realized with any compressible shape, in accordance with the invention. At least one element 200 and/or 210 occupies an arc or portion of the socket opening 100 perimeter less than the full perimeter. Also, at least one sealing element 200 and/or 210 is typically made from an elastic material, such as rubber, silicone and/or plastic. Now, as sealing element 200 is pushed with force 400 it will by virtue of its elasticity bend more open in the direction of arrows 440, 430. The net result of the applied pressure 400, is a compressible force that acts both down as indicated by arrows 410, 420 and inward 500, 510, squeezing the socket opening and tightening the seal and strengthening the sealing effect. The tension in the sealing elements 200 and 210 may be arranged so that the opening 100 is closed by the seal in its rest state, as shown in FIG. 1B.

At least one sealing element 200, 210 has the shape of an arc in some embodiments. Other shapes are also possible in accordance with the invention. However, in its current position and shape the outer perimeter of the arc element 200 and 210 interfaces with the socket opening 100 perimeter, and the inner perimeter of the arc element 200, 210 is directed outwards from the socket opening 100 perimeter. The outer perimeter of the sealing element 200, 210 is arranged to exert extra pressure on the socket opening 100 perimeter and/or the plug from the sides of its contact surface 300, 310 when an outside force tries to increase the inner perimeter of the arc of the sealing element 200, 210. Likewise, the outer perimeter of the sealing element is arranged to exert extra pressure on the socket opening 100 perimeter and/or the plug from the middle of its contact surface 300, 310 when an outside force tries to decrease the inner perimeter of the arc. This way, the pressure changes will be limited to the perimeter sector of each sealing element 200, 210 and will not effect the entire perimeter of the opening 100. Different sealing element shapes and mechanisms to distribute pressure are also in accordance with the invention.

In some embodiments the seal 200, 210 is arranged to be water and/or airtight when the plug is inserted through the seal. Further in some embodiments the seal 200, 210 is arranged to be water and/or airtight when there is no plug in the socket.

The socket can be in accordance with US, European, UK, Australian, Japanese or any other standard for an electrical socket and/or plug. Also more than one embodiments of the type of 10 and 11 can be arranged to form an integral socket accommodating more than one plugs. It is clear that any electric plug adapted to fit with the socket of the invention is also in accordance with the invention.

Figure 2:
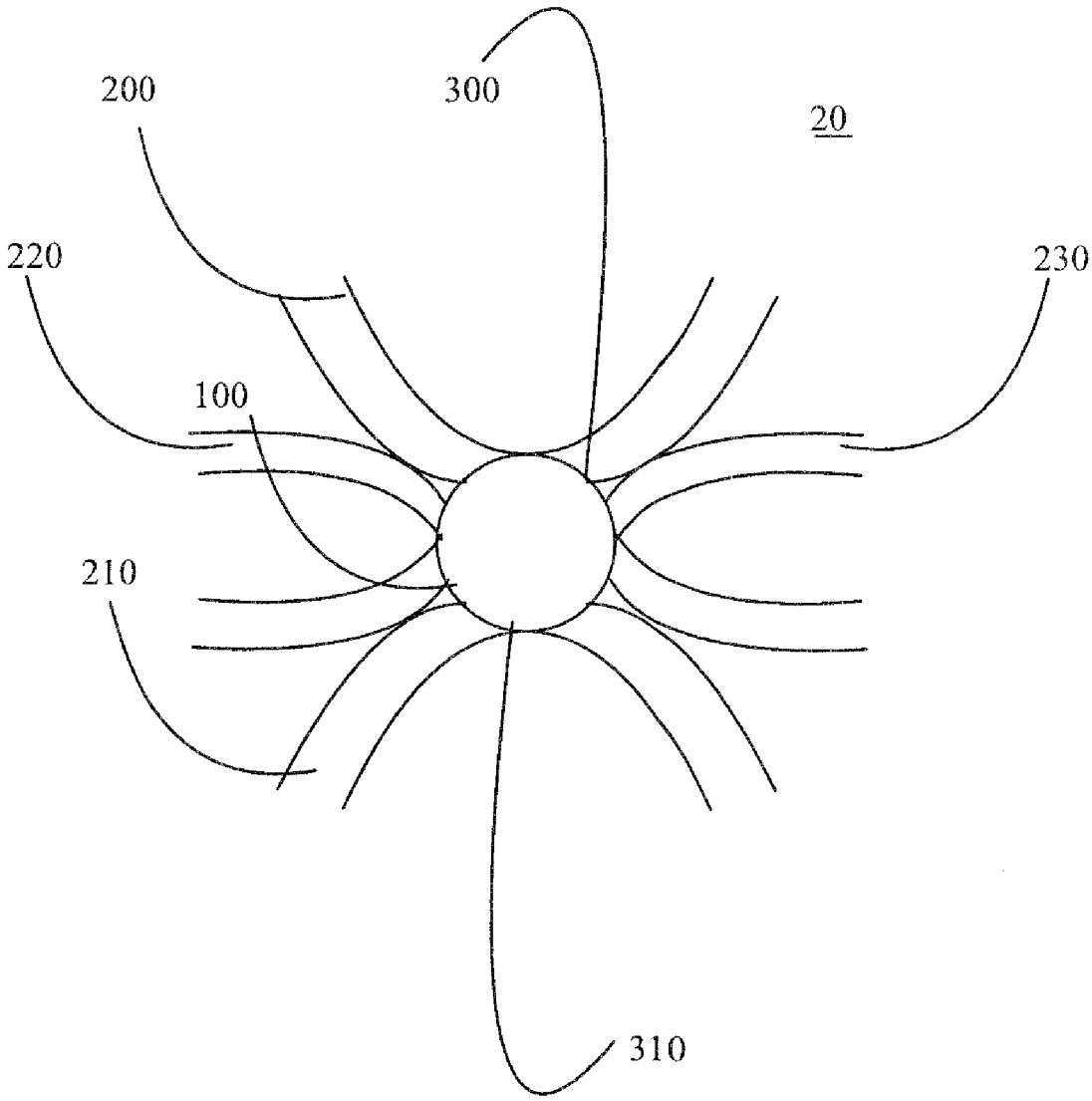
FIG. 2 demonstrates a more developed embodiment 20 of the inventive socket seal in accordance with the invention.

FIG. 2 displays a socket opening 100 that is protected by four sealing elements 200, 210, 220 and 230. All of these sealing elements work similarly to the sealing elements 200, 210 described in FIG. 1, except that they occupy a smaller sector of the perimeter of the opening 100. In this embodiment each sealing element is arranged to occupy a sector of 90 degrees. However it is possible that any arbitrary number of sealing elements 200, 210, 220 and 230 can be used to realise the seal. It is also possible and in accordance with the invention that the sealing elements 200, 210, 220, 230 occupy sectors of the perimeter that are of different size, for example sectors of 180, 60, 60 and 60 degrees. In this embodiment the shape of the sealing element is an arc, but in other embodiments the sealing element may be realized with any compressible shape, in accordance with the invention.

Figure 3:
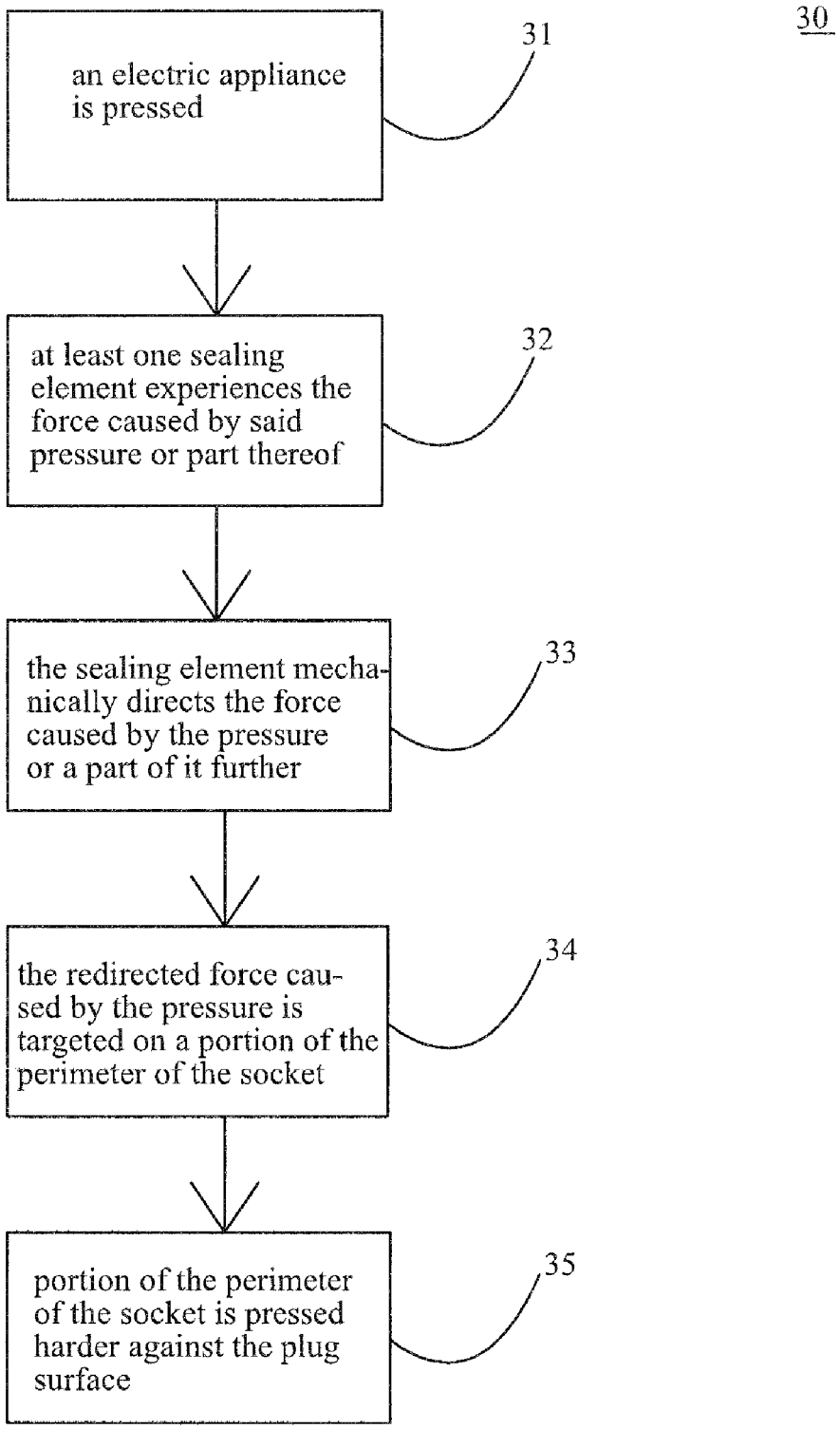
FIG. 3 demonstrates an embodiment 30 of the method that the seal and the sealing elements are arranged to execute in accordance with the invention as a flow diagram.

FIG. 3 displays a method of securing a plug and socket interface during the use of an electric appliance as described in the previous FIGS. 1, 1B and 2. In phase 31 the electric appliance is pressed, e.g. with fingers resulting in asymmetric pressure, or with a fluid, resulting in uniform symmetric hydrostatic pressure, or both. In phase 32 at least one sealing element experiences the force caused by the said pressure or a part of the aforementioned pressure. In phase 33 the sealing element mechanically directs the force caused by the pressure or a part of it further. The sealing element acts thus as a mechanical pressure and force relay station, in addition to performing a sealing role. In phase 34 the redirected force caused by the pressure is targeted on a portion of the perimeter of the socket. The portion of the perimeter may be anywhere between 0-360 degrees. There is also no need for the perimeter to be circular necessarily, the perimeter of the socket may also be square, triangular or in fact of ally shape. In phase 35 the portion of the perimeter of the socket is pressed harder against the plug surface, due to the redirected force caused by the pressure on the sealing element before.

Figure 4:
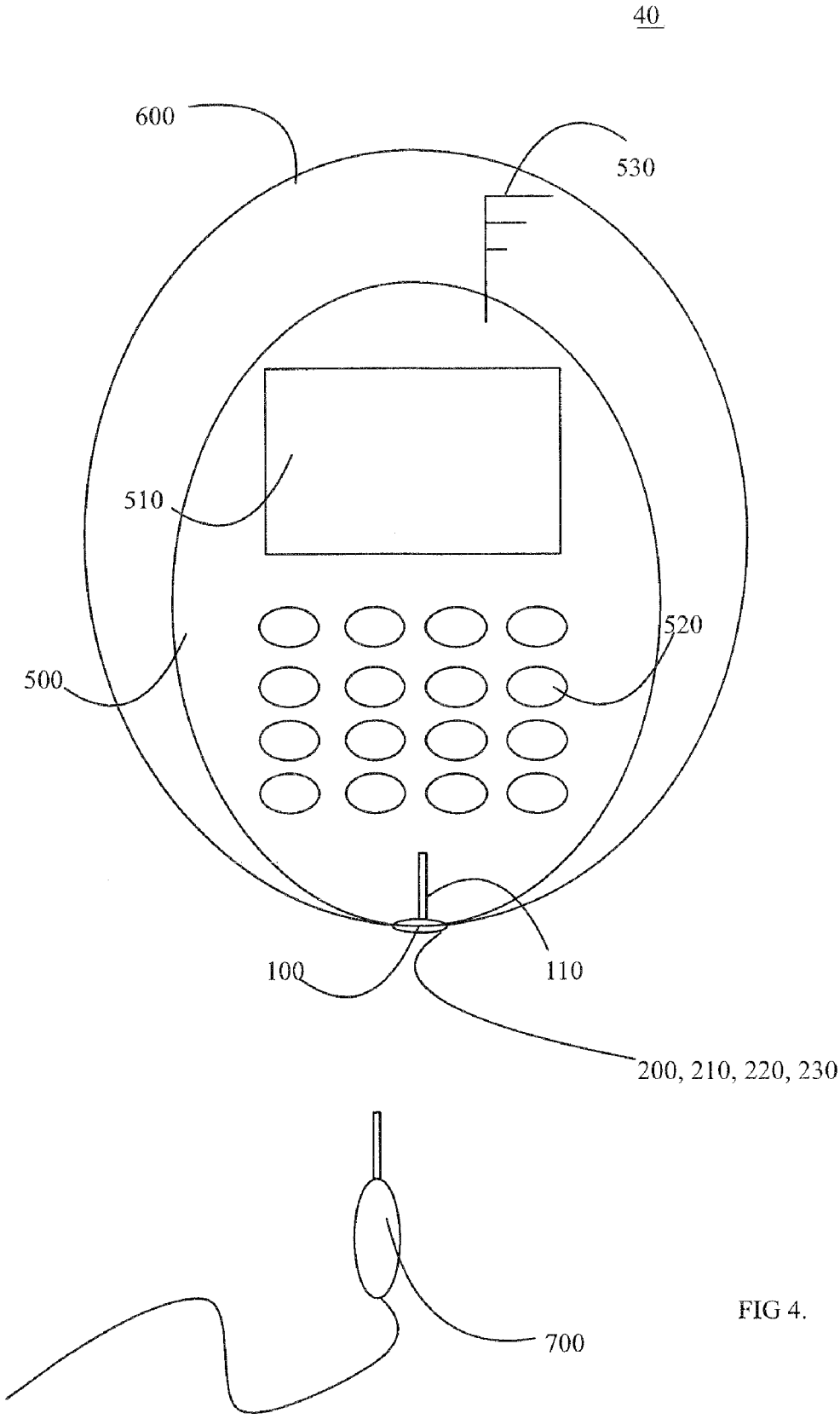
FIG. 4 demonstrates a developed embodiment 40 of the inventive socket seal used in a housing for an electrical device in accordance with the invention as a block diagram.

FIG. 4 shows a housing 600 arranged to house an electric appliance 500 comprising an opening 100 for an electric plug 700 and a seal 200, 210, 220, 230 for the opening. The electric appliance is a wireless communication device 500 with an antenna 530 in this embodiment. The device 500 may have a screen and a keyboard 520, and in some embodiments it can be removed from the housing. The housing is typically of elastic material such as, rubber, silicone and/or plastic.

The socket 110 of the electric appliance 500 and the seal of the housing 200, 210, 220, 230 protecting the socket opening 100 are arranged to form an electrical socket that is covered as described in association with the previous figures. Upon pressure on the housing 600, at least one sealing element 200, 210, 220, 230 is arranged to compress radially against the longitudinal plug 700 axis thereby tightening the seal 200, 210, 220, 230 of the socket 110 as described before. The sealing elements 200, 210, 220, 230 react to both symmetric and asymmetric pressure, by redirecting and limiting the mechanical force to the sector of the perimeter of the opening 100 to which that sealing element corresponds to, as explained in association with the previous figures.

In some embodiments the housing 600 has the shape of a ball. In other embodiments the electric appliance 500 may be a wireless computer mouse covered by the housing 600 and amounting to a solution as described in EP 05028777.0 of the applicant. In other embodiments the electric appliance 500 may be for example a wrist watch, clock, camera, music player, electric shaver, or any portable electric device in accordance with the invention. Also, in other embodiments of the invention the electrical appliance may be any wired or wireless control device, such as a remote control, for example.

The plug 700 is typically cylindrical but any plug 700 and socket 110 shape may be implemented with the sealing elements 200, 210, 220 and 230 in accordance with the invention. The sealing elements 200, 210, 220 and 230 and the housing 600 typically provide water and/or airtight sealing to the electric appliance 500 in some embodiments.

Figure 5:
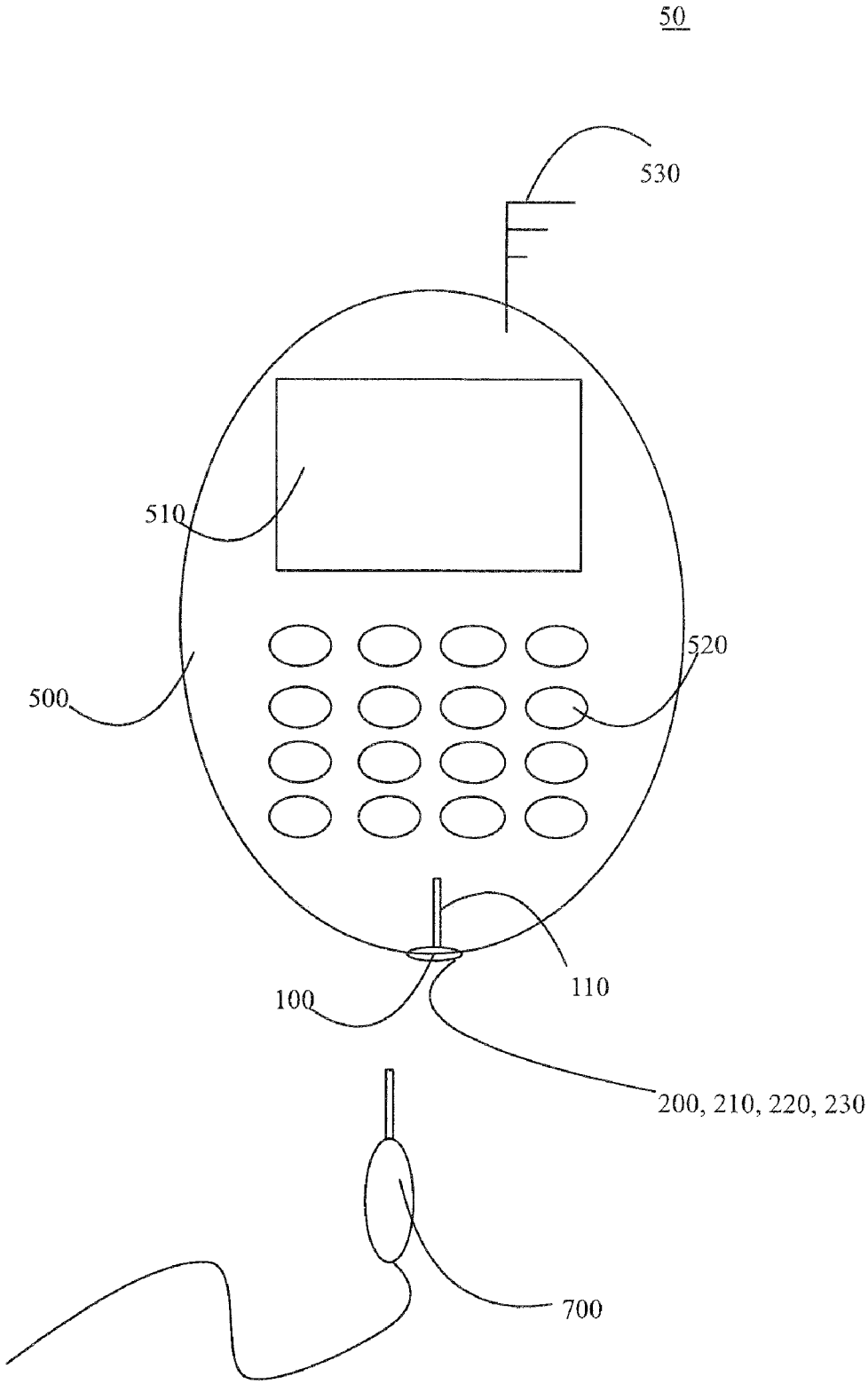
FIG. 5 demonstrates an embodiment 50 of the inventive socket seal integrated into an electrical device in accordance with the invention as a block diagram.

FIG. 5 displays an embodiment 50 of an electric appliance 500 with a socket 110, socket opening 100 and a seal composed of the previously described sealing elements 200, 210, 220 and 230. In this embodiment the electric appliance 500 is a mobile wireless communication device, such as a mobile phone. In other embodiments the electric appliance 500 may be for example a wrist watch, clock, camera, music player, electric shaver, or any portable electric device in accordance with the invention. However the sealing elements 200, 210, 220 and 230 can be used to realise a water- and/or airtight seal on any wireless portable device, or any socket or plug for that matter, including but not limited to wall sockets and plugs.

In many embodiments all or some parts of the socket 110, plug 700 and/or seal 200, 210, 220, 230 are manufactured by moulding and/or injection moulding from know materials such as rubber, silicone and/or plastics.

Figure 6:
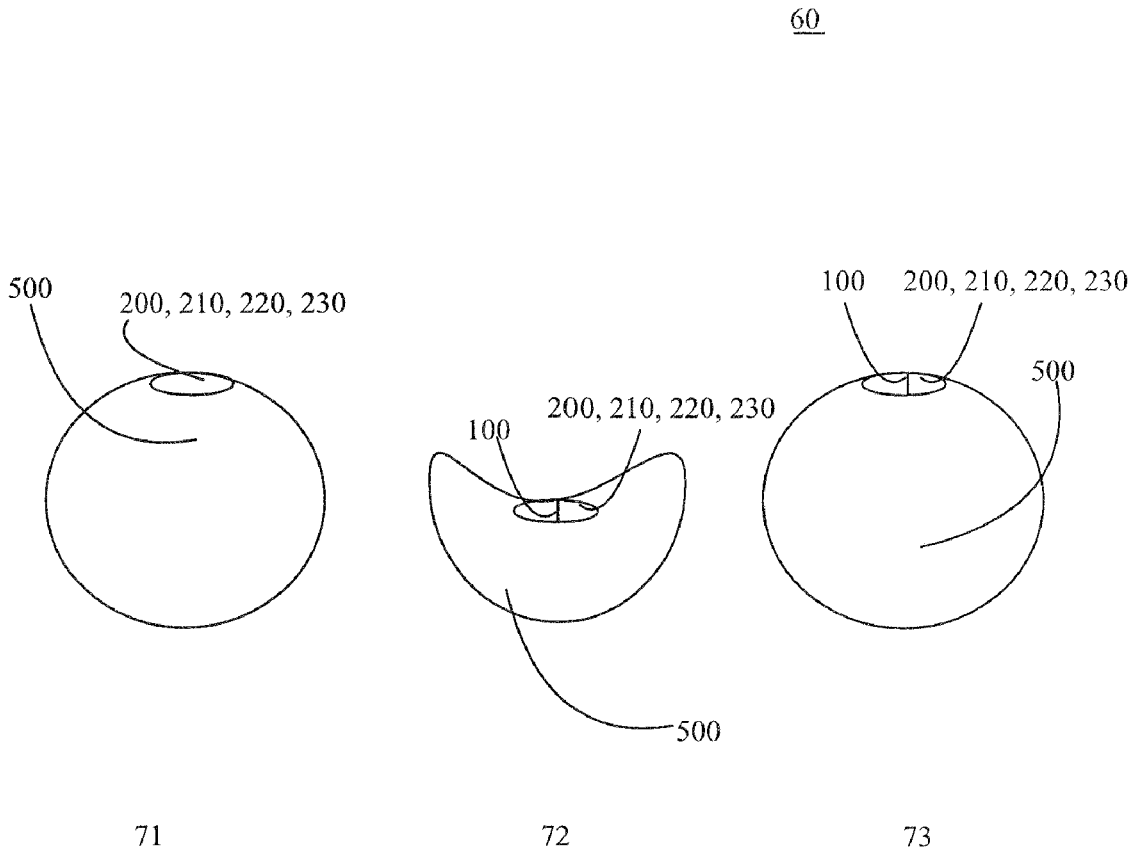
FIG. 6 demonstrates an embodiment 60 of the method for manufacturing the seal and the opening of the invention to a spherical housing 500.

In FIG. 6 the housing 500 and the seal elements 200, 210, 220, 230 are shown in stage 71. In stage 72 the housing 500 is compressed and a cut 100 is made to the seal 200, 210, 220 and 230. The cut 100 will form the opening 100 when the housing 500 is restored to its original shape. With the arc shaped elements 200, 210, 220, 230 the opening 100 is compressed to closure and/or to a tighter state in stage 73 than in stage 72 in some embodiments.

The invention has been explained above with reference to the aforementioned embodiments and several commercial and industrial advantages have been demonstrated. The methods and arrangements of the invention allow the socket opening to be sealed in an water- and/or airtight manner even in asymmetric pressure conditions, for example when pressed with fingers, both when there is no plug 700 in the socket 110 and also when a plug 700 is inside the socket 110.

The invention has been explained above with reference to the aforementioned embodiments. However, it is clear that the invention is not only restricted to these embodiments, but comprises all possible embodiments within the spirit and scope of the inventive thought and the following patent claims.

REFERENCES

U.S. Pat. No. 4,948,377, James L. Cairns, "Submersible electrical connector"

EP 05028777.0

The invention claimed is:

1. An electrical socket realised in an electrical appliance for housing a plug with the socket further comprising a seal, and the seal is composed of at least two sealing elements arranged to seal the socket opening, the plug is arranged to penetrate through the seal and then through the opening upon insertion of the plug into the socket, wherein at least one of said sealing elements occupies an arc or portion of the socket opening perimeter less than the full perimeter, said at least one sealing element is configured to have a shape of an arc that opens in a direction away from the socket opening upon pressure on the electrical appliance, at least one of said sealing elements is configured to compress radially against a longitudinal axis of the plug thereby tightening the seal of the socket.

2. The electrical socket as claimed in claim 1, wherein each sealing element has the shape of an arc.

3. The electrical socket as claimed in claim 2, wherein the outer perimeter of the arc element interfaces with the socket opening perimeter, and the inner perimeter of the arc element is directed outwards from the socket opening perimeter.

4. The electrical socket as claimed in claim 3, wherein the outer perimeter is arranged to exert pressure on the socket opening perimeter and/or the plug from the sides of its contact surface when an outside force for increasing the inner perimeter of the arc is applied.

5. The electrical socket as claimed in claim 3, wherein the outer perimeter is arranged to exert pressure on the socket opening perimeter and/or the plug from the middle of its contact surface when an outside force for decreasing the inner perimeter of the arc is applied.

6. The electrical socket as claimed in claim 1, wherein at least one sealing element is made from an elastic material.

7. The electrical socket as claimed in claim 1, wherein at least one sealing element is made from rubber, silicone and/or plastic.

8. The electrical socket as claimed in claim 1, wherein the socket is in accordance with US, European, UK, Australian, Japanese or any other standard for an electrical socket and/or plug.

9. The electrical socket as claimed in claim 1, wherein the seal is arranged to be water and/or airtight when the plug is inserted through the seal.

10. The electrical socket as claimed in claim 1, wherein the seal is arranged to be water and/or airtight when there is no plug in the socket.

11. The electrical socket as claimed in claim 1, wherein the electrical appliance is a spherical mouse and/or any other wireless control device.

12. An electric plug adapted to fit with the socket of claim 1.

13. Electric socket comprising a housing arranged to house an electric appliance comprising an opening for an electric plug and a seal for the opening, wherein the socket of the electric appliance and the seal of the housing are arranged to form an electrical socket of claim 1.

14. The socket of claim 13, wherein the housing has the shape of a ball.

15. The socket of claim 13, wherein upon pressure on the housing at least one of said sealing elements is arranged to compress radially against the longitudinal axis of the plug thereby tightening the seal.

16. Method of producing the socket of claim 1, wherein all or some parts of the socket, plug and/or seal are manufactured by moulding and/or injection moulding.

17. Method of securing a plug and socket interface as claimed in claim 1, comprising the following steps:

applying pressure to an electric appliance or its housing, causing at least one of said sealing elements to experience the force caused by the pressure or a part thereof, causing the sealing element to mechanically redirect the force caused by the pressure or a part thereof further, targeting the redirected force caused by the pressure on a portion of the perimeter of the socket, and pressing the portion of the perimeter of the socket harder against the plug surface due to the added redirected force caused by the pressure.

18. Method of producing the socket of claim 13, wherein all or some parts of the socket, plug and/or seal are manufactured by moulding and/or injection moulding.

* * * * *